United States Patent [19]

Martenson

[11] 4,305,373

[45] Dec. 15, 1981

[54] FIREPLACE FURNACE

[76] Inventor: Donald S. Martenson, 24430 S. Highway 99E, Canby, Oreg. 97013

[21] Appl. No.: 95,571

[22] Filed: Nov. 19, 1979

Related U.S. Application Data

[63] Continuation-in-part of Ser. No. 973,875, Dec. 28, 1978, Pat. No. 4,263,889, and a continuation-in-part of Ser. No. 843,986, Oct. 20, 1977, Pat. No. 4,166,444.

[51] Int. Cl.[3] ..... F24B 7/00

[52] U.S. Cl. ..... 126/121; 126/123; 126/131; 126/290

[58] Field of Search ..... 126/121, 120, 123, 126, 126/131, 77, 139, 141, 6, 193, 290; 237/51; D23/94

[56] References Cited

U.S. PATENT DOCUMENTS

| | | | |
|---|---|---|---|
| 1,433,520 | 10/1922 | Aizpuru | 126/121 X |
| 3,965,886 | 6/1976 | Nelson | 126/121 |
| 3,995,611 | 12/1976 | Nelson | 126/121 |
| 4,015,581 | 4/1977 | Martenson | 126/123 X |
| 4,131,105 | 12/1978 | Moncrieff-Yeates | 126/121 |
| 4,185,610 | 1/1980 | Buckner | 126/121 |
| 4,193,387 | 3/1980 | Cline | 126/121 |

FOREIGN PATENT DOCUMENTS

| | | | |
|---|---|---|---|
| 137766 | 6/1950 | Australia | 126/121 |

*Primary Examiner*—Samuel Scott
*Assistant Examiner*—Randall L. Green
*Attorney, Agent, or Firm*—Klarquist, Sparkman et al.

[57] ABSTRACT

A fireplace furnace is insertable as a unit into the front opening of an existing fireplace. It has a firebox portion and can also have a cookstove extension of the firebox which protrudes into the room when the firebox is positioned in a fireplace. A sheet metal jacket around the firebox encloses a first air space. Double side walls of the firebox define a second air space. Frontal air openings connect both air spaces to the ambient room air. Rear openings in the outermost side walls interconnect the two air spaces at the rear of the firebox. Heat exchange tubes communicating with the first air space at the back of the firebox pass through the firebox to air discharge openings at the front of the unit. Air intake blowers in the first air space are insulated from the firebox by the second air space. Baffles in the first air space direct the incoming air flow rearwardly along the outer side walls, deflect a portion of such flow into the second air space, and divide another portion of such flow approximately equally among the heat exchange tubes. The unit has a front access opening and door with adjustable draft control mechanism.

23 Claims, 15 Drawing Figures

FIG. 1
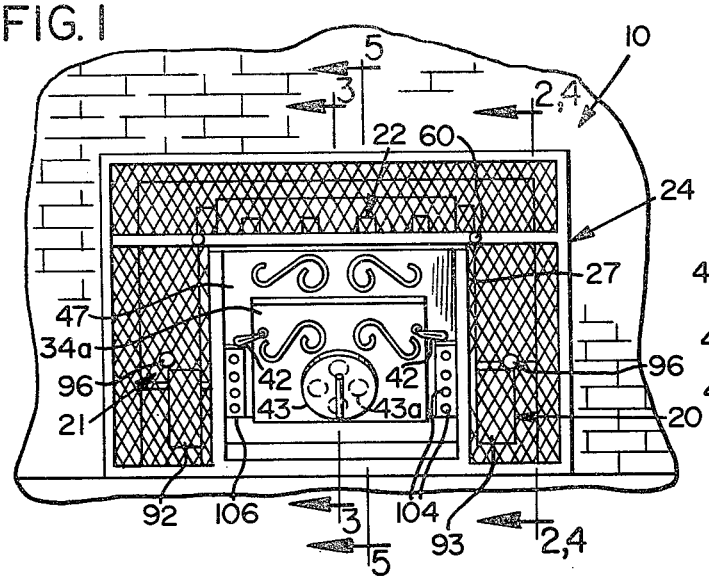
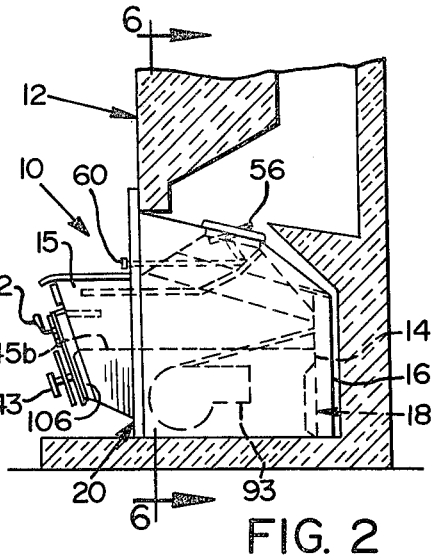
FIG. 2
FIG. 3
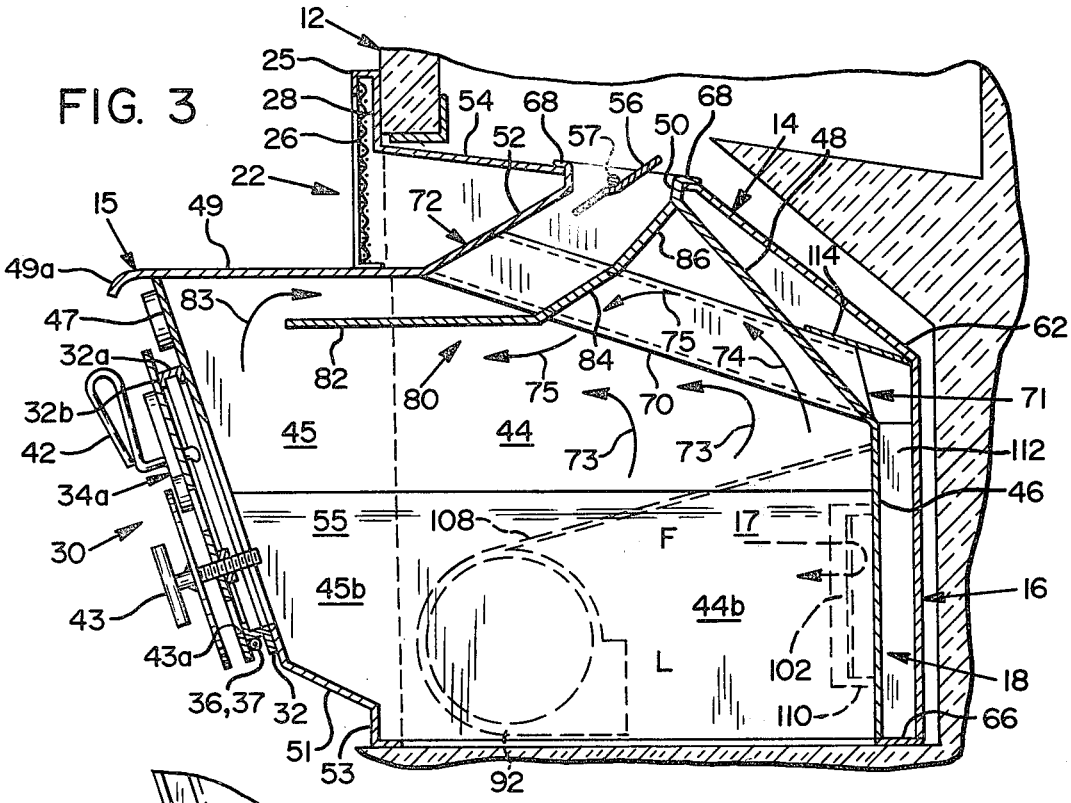
FIG. 8
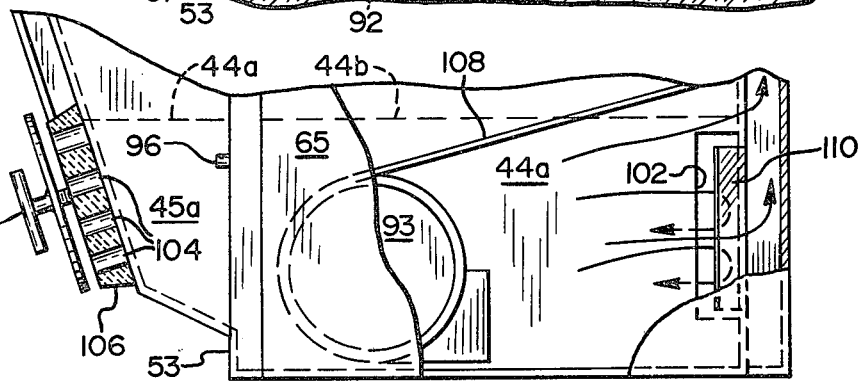

FIREPLACE FURNACE

CROSS REFERENCES TO RELATED APPLICATIONS

This is a continuation-in-part of my patent for COMBINATION FIREPLACE FURNACE AND COOKSTOVE, Ser. No. 973,875, filed Dec. 28, 1978 U.S. Pat. No. 4,263,889; such application being a continuation-in-part of my then copending application for patent for FIREPLACE FURNACE WITH HEAT EXCHANGE TUBES, Ser. No. 843,986, filed Oct. 20, 1977, now U.S. Pat. No. 4,166,444.

BACKGROUND OF THE INVENTION

The present invention relates generally to fireplace furnaces adapted for insertion within existing conventional fireplaces.

Conventional fireplaces are notoriously inefficient room heaters because they draw warm air into the fireplace and up the chimney when used. This problem can be solved by use of doors on the fireplace, but their use substantially reduces the radiation of heat from a fire in the fireplace into the room.

To improve the efficiency of such fireplaces, several approaches have been taken. Fireplace furnaces of the "heat-alator" type are well known, in which the fireplace itself is built with special heat outlet openings in the front wall of the fireplace above or alongside the fireplace opening so that air can be circulated along side and rear heat exchanging surfaces of the firebox and heated for discharge into the room through such openings. However, these designs all require either rebuilding or modification of an existing fireplace or installation of the furnace during the original construction of the fireplace.

To provide a more efficient fireplace furnace, I designed a self-contained prefabricated fireplace furnace for insertion within a conventional fireplace, shown in my U.S. Pat. No. 4,015,581, issued Apr. 5, 1977. The heater unit includes a metal firebox within a surrounding metal jacket. Room air is drawn into side inlet openings at the front of the jacket, warmed by the firebox walls serving as heat exchange surfaces, and then expelled back into the room through an upper portion of the jacket, all by natural convection. Although this heater is satisfactory to maintain warm temperatures in a room, it requires a considerable length of time to heat a cold room because of the low rate of air movement through the heater.

Use of fans to provide forced air circulation through fireplace heaters has been proposed in U.S. Pat. Nos. 2,642,859 and 2,743,720. However, use of such fans does not entirely solve the problem because of their tendency to move air through the heater and back into the room before the air can be adequately warmed by the limited heat exchange surfaces of the heater.

I therefore advised a further improved fireplace furnace as disclosed in my application for patent, Ser. No. 843,986, filed Oct. 20, 1977, now U.S. Pat. No. 4,166,444. Such furnace has a jacketed firebox with heat exchange tubes extending through the firebox from the airspace at the rear of the firebox to discharge openings at the front of the firebox. This design enables efficient use of the heat produced by a fire by circulating room air, first through the side and rear airspaces and then through the heat exchange tubes, thereby exposing such air to progressively hotter portions of the firebox chamber.

As a further development of the foregoing design, I devised a combination fireplace furnace and cookstove as disclosed in my application for patent, Ser. No. 973,875, filed Dec. 28, 1978. This design includes a cookstove portion which protrudes into the room from the firebox when the firebox is positioned in the fireplace. Such portion can be used for cooking and increases the effectiveness of the furnace because of its ability to radiate heat from the exposed surfaces of the cookstove portion into the room as well as circulate warm room air.

In the use of conventional wood stoves it is common practice to bank the coals of a fire at night and to reduce the draft to slow their burning, so that the fire can be easily restarted from the glowing coals in the morning. It would also be desirable to be able to bank a fire in the fireplace furnaces of my foregoing patents and applications. However, banking has not proven feasible because of the proximity of the blowers to the hot side walls of the firebox. The electric motors of such blowers can be damaged by the extreme heat of the banked coals particularly when the blowers are turned off.

Therefore, a primary object of the present invention is to provide a fireplace furnace having all of the advantages of my prior fireplace furnaces and, in addition, the ability to safely and effectively bank the coals of a fire when desired without damaging the blowers.

Another primary object of the invention is to increase the heating effectiveness of my fireplace furnaces.

A specific object of the invention is to further enhance the ability of my fireplace furnaces to progressively heat ambient room air through improved air circulation within the furnace airspaces and improved firebox baffling.

SUMMARY OF THE INVENTION

In accordance with the present invention a fireplace furnace has a double side wall construction which provides an insulating airspace for protecting the blowers from heat damage. Thus, the coals of a fire can be banked along the double side walls without risk of damage to the blowers. The blowers remain relatively cool even when turned off because natural convection induces a continuous flow of room air into the airspace. Such convective air flow is enhanced by heat exchange tubes passing at an upward inclination through the firebox from rear air intake openings to front air discharge openings.

The airspaces provided by the double side walls also provide heat ducts through which room air is circulated and heated by the heat exchange surfaces provided by such side walls. Thus, the ducts provided by such side walls supplement the heat exchange tubes in heating the room.

Four sets of baffles are positioned within the first air space to improve air flow. One set extends generally horizontally along the side walls to divide the first air space into upper and lower portions and thereby encourage convection, and inducing rearward air flow in the lower portions and forward warmed air flow in the upper portions. A second set extends vertically, rearwardly of the rear openings in the outer side wall portions, to divert a portion of the inflowing air into the second air space. A third baffle is centered in the first air space at the back of the firebox to divide the inflow of air approximately equally among multiple heat exchange tubes. A fourth baffle extends horizontally across the rear of the firebox in the first air space above the heat exchange tubes and third baffle to direct most of the divided air flows into the heat exchange tubes.

The foregoing features can also be incorporated into my combination fireplace furnace and cookstove. The double-walled side walls of the firebox extend forwardly into the stove chamber to define side walls of the cookstove portion and extended heat exchange ducts which discharge hot air into the room.

An interior baffle in the firebox extends across an upper portion of the box and intersects a rear firebox wall portion. This baffle also extends forwardly into the stove chamber, forcing all combustion gases to follow a prolonged exhaust path from the firebox through the stove before being discharged to the chimney, thereby enhancing the extraction of heat from such gases to increase the efficiency of the furnace.

The foregoing and other objects, features and advantages of my present invention will become more apparent from the following detailed description of two preferred embodiments, which proceeds with reference to the accompanying drawings.

BRIEF DESCRIPTION OF THE DRAWINGS

In the drawings:

FIG. 1 is a front elevational view of a fireplace furnace according to my invention installed within an existing fireplace;

FIG. 2 is a vertical sectional view taken along line 2—2 through the fireplace of FIG. 1, but not through the fireplace furnace, to show one embodiment of my invention positioned within the fireplace;

FIG. 3 is a vertical sectional view on an enlarged scale taken along line 3—3 of FIG. 1;

FIG. 8 is an enlarged view of the lower portion of the fireplace furnace of FIG. 2, portions of the jacket being cut away to reveal interior features;

DETAILED DESCRIPTION OF A PREFERRED EMBODIMENT

Figure 5:
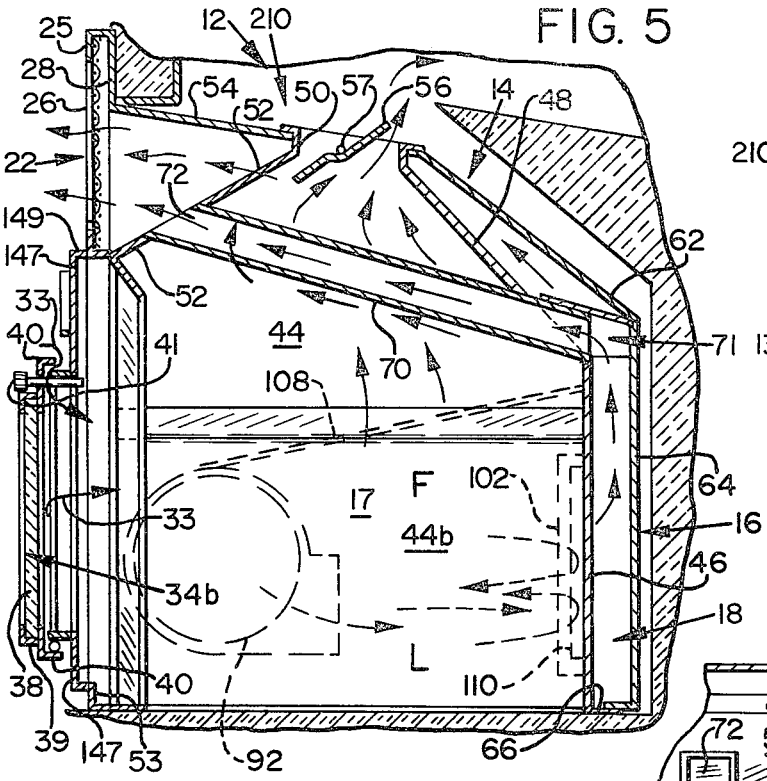
FIG. 5 is a vertical sectional view of the embodiment of FIG. 4 on an enlarged scale taken along a line corresponding to line 5—5 of FIG. 1.
Figure 4:
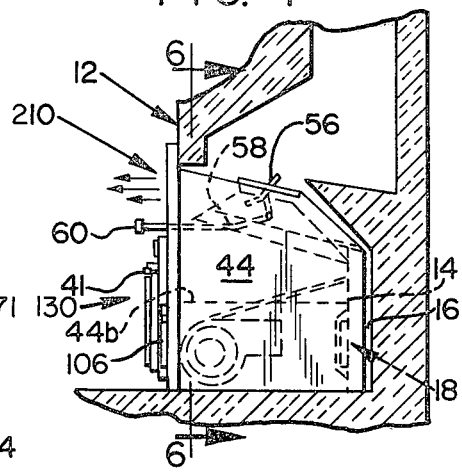
FIG. 4 is a vertical sectional view taken along line 4—4 through the fireplace of FIG. 1, but not through the fireplace furnace, to show a second embodiment of my invention positioned within the fireplace.

Referring to the drawings, FIGS. 2 and 3 show a first preferred embodiment of my invention while FIGS. 4 and 5 show a second preferred embodiment. Features common to both embodiments are shown in FIGS. 1, 6, 7 and 8. Since the two embodiments are quite similar I will describe the first embodiment fully. Then, using the same reference numerals to identify features common to both embodiments, I will describe the features of the second embodiment which differ from those of the first embodiment.

FIG. 3 Embodiment

Referring to FIGS. 1–3, a combination fireplace furnace and cookstove apparatus 10 is inserted somewhat like a drawer into the opening of a fireplace 12. The apparatus 10 includes a firebox portion 14 positioned within fireplace 12 and a cookstove portion 15 protruding forwardly from the fireplace. Both portions 14 and 15 are preferably made of heavy gauge steel. The opposite sides, back and top walls of the firebox portions 14 surround a firebox chamber 17 for containing fire F. Firebox portion 14 is, in turn, surrounded by a sheet metal jacket 16. The walls of the jacket are spaced outwardly from the walls of the firebox portion to define a first air space 18 therebetween.

The front of the jacket 16 is open and substantially flush with the front wall of the fireplace 12. The open front of the jacket on each side of the firebox portion defines frontal air openings 20, 21. The openings are baffled to divide each opening into a lower intake portion for admitting ambient room air into the first air space and an upper discharge portion for discharging warmed air back into the room. The open front of the jacket above the upper wall portions of the firebox portion defines a warm air outlet opening 22 through which additional warmed room air is discharged back into the room.

The front openings of the jacket are covered with a grille front 24 including a rigid grille frame 25 and grille screen 26 supported by the frame. The grille front extends from a flange 27 defining an inner margin surrounding the firebox portion to outer margins terminating outwardly beyond the outer margins of the fireplace front opening. Those portions of the grille front extending beyond the outer margins of the jacket 16 are backed by sheets of air-impervious backing material 28, such as asbestos or sheet metal, as shown in FIGS. 3 and 7, to prevent room air from entering the fireplace opening around the furnace and flowing up the fireplace chimney. Thus, when the furnace is installed in a fireplace, room air can only enter either the firebox chamber as draft air for the fire, or the jacketed air space for heating and recirculation into the room. The firebox portion has vertical opposite side walls 44 (FIG. 6) meeting a vertical back wall 46. Each side wall 44 has a double-walled lower portion in which an outer side wall **44*a* and an inwardly-spaced inner side wall 44*b* define a second air space 100. Vertical rear air openings 102 extend through outer side walls 44*a* near rear wall 46** to interconnect the first and second air spaces so that air can flow between them.

The upper wall of the firebox portion includes a rear upper wall portion 48 pitched downwardly and rearwardly from a top exhaust opening or flue 50 and a front upper wall portion 52 pitched downwardly and forwardly from exhaust opening 50. Exhaust opening 50 extends through a top wall 54 of jacket 16 to allow for the escape of hot gases and smoke from the apparatus into the fireplace chimney. Exhaust opening 50 extends substantially the full width of the firebox portion. A damper plate 56 mounted on a shaft 57 within exhaust opening 50 is operated by a lever and rod type actuating linkage means 58 as shown in FIGS 2, 3 and 4. The linkage terminates at a knob 60 at the grille front 24 for adjusting the degree of closure of exhaust opening 50.

The bottom of the firebox portion is open as shown in FIG. 7, so that the existing fireplace floor can be used to build a fire and to collect ashes. This feature also prevents the possibility of burning out a bottom wall of the firebox portion, which is especially advantageous if the coals are banked at night.

Jacket 16 includes the slightly rearwardly and downwardly sloping forward top wall portion 54 and a more steeply pitched rear top wall portion 62. A generally vertical rear wall 64 joins the rear top wall portion and generally vertical opposite side walls 65. The jacket side walls slope rearwardly and inwardly to conform to the usual shape of the side walls of a fireplace, best seen in FIGS. 6 and 7. Although the bottom of the firebox is open as previously mentioned, the bottom of the jacket is closed by a bottom wall 66, which connects the firebox to the jacket so that they are unitary. The firebox and jacket are also interconnected at flanged portions 68 surrounding the firebox exhaust opening 50.

The cookstove portion 15 has vertical opposite side walls 45 which are forward continuations of firebox side walls 44. Side walls 45 meet a front wall 47, a top wall 49 providing a cooking surface or cooktop, and bottom wall portions 51 and 53 to enclose a stove chamber 55 which is a forward continuation of firebox chamber 17. Each side wall 45 also has a double walled lower portion in which outer and inner side walls **45*a*, 45*b* are forward continuations of side walls 44*a*, 44*b*, respectively. Accordingly, the second air space 100** extends to the front of the cookstove portion.

Cooktop 49 is a heavy horizontal rectangular plate which meets the front upper wall 52 rearwardly of the grille front 24. Cooktop 49 overlaps side walls 45 and front wall 47. For safety reasons the front overlapping portion **49*a* of cooktop 49** is bent downward in a smooth curve.

Bottom wall portion 53 is a generally vertical wall connected to flanges 27 at each end. The bottom edge of wall portion 53 is adapted for sealing against the fireplace floor and the top edge of wall 53 is connected to wall portion 51. Wall portion 51 is inclined upwardly and forwardly at about 60° from vertical and connects to the bottom edge of front wall 47. Wall portion 51 is connected to the lower, frontal edges of side walls **45*a* and 45*b***.

Front wall 47 is inclined upwardly and forwardly at about 30° from vertical and is connected to the forward edges of side walls 45, **45*a* and 45*b***.

A rectangular front access opening 30 is provided through front wall 47 for permitting access to the chambers 17 and 55, for example, for adding fuel to the fire. Frontal air openings, such as the vertical rows of holes 104, extend through front wall 47 on each side of the access opening, to connect the second air space 100 to the ambient room air. An ornamental cowling 106, shown in cross-section in FIG. 8, can be provided for each row of holes.

Around the perimeter of opening 30 is an access opening frame 32 for mounting access door **34*a* (FIG. 3) or 34*b* (FIG. 5). The frame comprises a first flange portion 32*a* extending normally outward from wall 47, and a second flange portion 32*b* extending from the first portion 32*a* inwardly toward opening 30 parallel to front wall 47. Two hinge mounts 36 are provided in the lower horizontal member of frame 32 for mounting access door 34. Mounts 36 are hollow cylinders for receiving hinge pins 37** at the bottom of the door so that the door can be opened downwardly. The opening frame is designed so that a variety of doors can be used interchangeably on the apparatus.

One such door is a steel door **34*a* designed to fit tightly against frame 32 when mounted on hinges 36, 37 to provide air-tight closure of the access opening. Two simple rotating latches 42 latch door 34*a* by rotating radial members beneath flanges 32*b* of the access opening frame. A manually adjustable draft mechanism 43, or a thermostatically-controlled draft mechanism (not shown), is positioned below the center of door 34*a* to admit air into the stove chamber through circular apertures 43*a* in the door. Mechanism 43 includes a circular cover, sized to overlap apertures 43*a*, mounted at its center on a threaded shaft screwed into an internally threaded hole in the door. The opposite end of the shaft has a T-shaped handle for rotating the shaft. Apertures 43*a* are four circular holes through door 34*a*** positioned symmetrically about the shaft. The draft of air through the apertures is adjusted by rotating the shaft to screw the mechanism outward from the door to admit more air or inward for less air.

A glass door **34*b* of the type shown in FIG. 5 is interchangeable with steel door 34*a*. The glass door has a rectangular transparent tempered glass plate 38 mounted in the door frame by a flange 39 which overlaps the edge of the glass. Door 34*b* includes a flange 40 which partially overlaps frame 32 and is spaced therefrom when the door is mounted to provide a gap about the periphery of the door. Room air can enter the firebox through the resulting gap as shown by arrows 33. This design simultaneously provides draft air to the fire chamber and an air barrier over the inside of the glass to protect it from heat and smoke. A simple rotating latch 41 latches the door by rotating a radial member beneath a flange 32*b*** of the access opening frame.

A row of upper heat exchange tubes 70 extend through an upper portion of the firebox chamber. Each tube 70 has an air intake opening 71 communicating with the air space within the back the jacket 16 and a front discharge opening 72 opening into a jacket air space 22 above the rear edge of cooktop 49.

The upper heat exchange tubes 70 pass through the firebox chamber at an inclination from back to front thereof and are of rectangular cross-section with a flat bottom surface facing downwardly toward the fire F within the firebox. Thus, to heat the tubes, hot smoke and gases rise from fire F and flow upwardly and forwardly along such tubes, as shown by arrows 73 in FIG. 3, as well as passing upwardly about such tubes, as shown by arrows 74.

Figure 6:
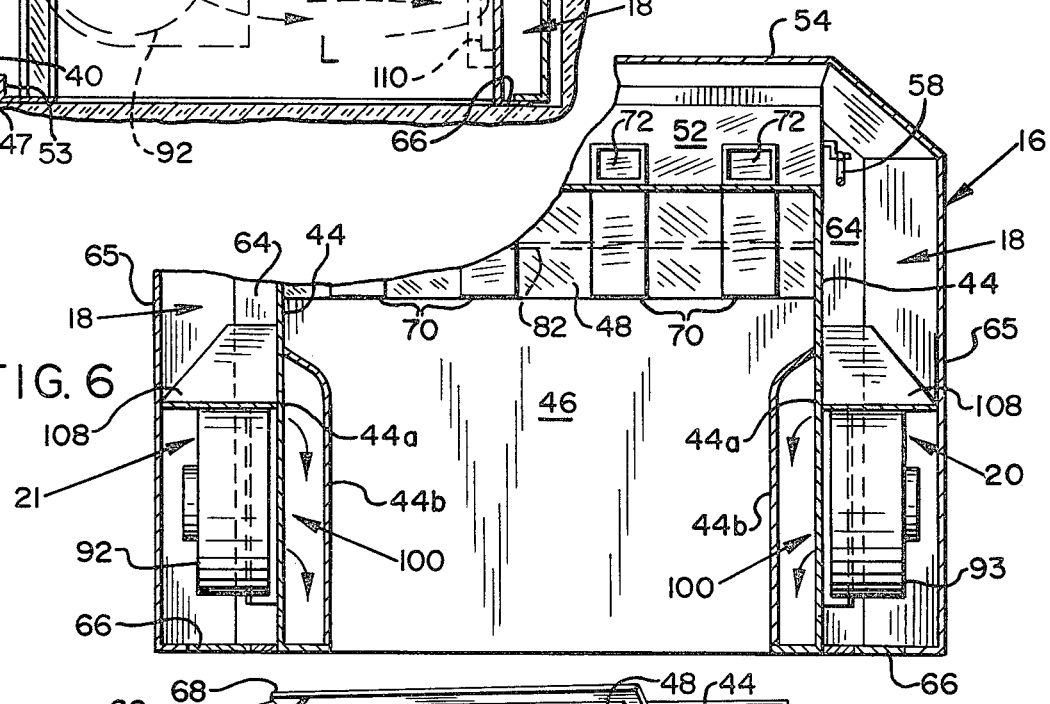
FIG. 6 is a vertical sectional view taken along line 6—6 through the fireplace furnaces of FIGS. 2 and 4.
Figure 7:
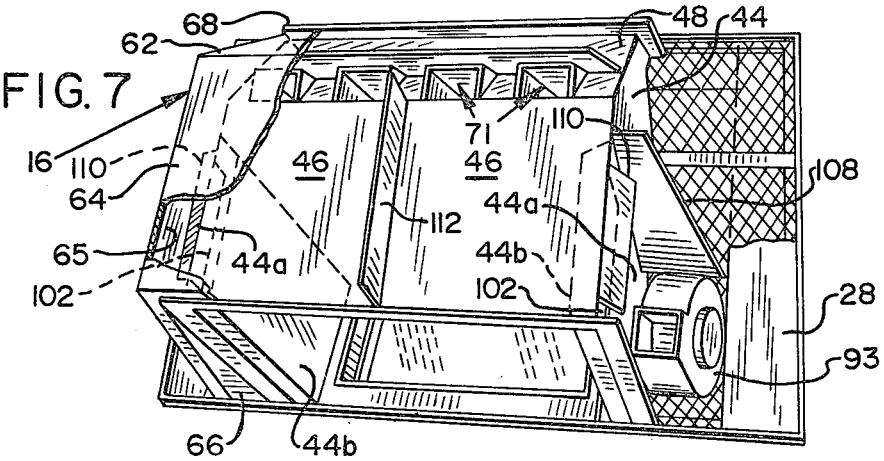
FIG. 7 is a perspective view of the fireplace furnaces of FIGS. 1–6 as viewed toward the lower rear side of the furnace, a large portion of the jacket being cut away to reveal interior features.

In FIGs. 6 and 7, there are four upper tubes spaced apart horizontally across the upper portion of the firebox chamber through substantially its entire width. However, any number of such tubes could be provided, including, if desired, other rows of tubes above or below the row of tubes 70. Tubes 70, heated directly by hot gases and smoke from fire F, heat air entering through inlets 71 from the air space at the back of the firebox. The heated air passes from tube outlets 72 into jacket air outlet 22, through grille screen 26 and returns to the room in which the fireplace is situated.

A baffle 80 extends between opposite side walls 44, 45 across an upper part of the firebox chamber 17 and stove chamber 55 for directing hot smoke and gases rising from fire F forward toward the front of the cookstove portion. Baffle 80 includes a horizontal forward portion 82, inclined intermediate portions 84 and rear portion 86.

Horizontal portion 82 is spaced below the cooktop 49, and has a front edge spaced rearwardly from front wall 47 to provide, together with the cooktop, a pathway indicated by arrow 83 for smoke and gases to pass in contact with the cooktop, front wall and upper portions of side walls 45.

Intermediate baffle portions 84 are gently inclined continuations of forward portion 82 which extend between tubes 70 and side walls 44 to seal off these areas from the upward passage of smoke and combustion gases.

Rear baffle portion 86 is positioned above tubes 70 and rearwardly of intermediate baffle portions 84, and extends horizontally between side walls 44. It extends upwardly and rearwardly from portions 84 to meet wall 48 adjacent to flue 50. Thus, the baffle 80 forms a complete barrier for directing all of the smoke and hot gases forwardly along rear portions of the tubes, into the cookstove portion and then rearwardly beneath cooktop 49 and around forward portions of the tubes, as indicated by arrows 74, 75 and 83.

A pair of electric-motor operated blowers 92, 93 are mounted in front openings of the first air space 18, one on each side of the firebox. They are operated by control knobs 96 to blow ambient room air rearwardly into the first air space.

Referring to FIGS. 6–8, a system of baffles within the first air space directs incoming air into the second air space 100 and to selected heat exchange surfaces and tubes. A first baffle 108 extends along each side wall **44, 44*a* at an upward inclination from a position just above each blower and near the frontal opening to a position at the rear of the firebox portion just above rear opening 102. Each baffle extends horizontally between the firebox side wall and jacket wall 65 to divide each of air openings 20, 21 into a lower intake portion and an upper discharge portion. Such baffles conduct the incoming airflow rearwardly along the side walls 44*a* to rear openings 102** and to the rear portion of the first air space. Such air flow can be induced either by operation of the blowers or by convection when the blowers are off.

A second baffle or diverter 110 extends vertically into the first air space from a connection point just rearward of each rear opening 102. Baffle 110 extends only part way across the first air space and is inclined toward the frontal air opening to divert a portion of the incoming air flow through the rear opening into the second air space 100. The remainder of the air flow passes between baffle 110 and jacket walls 65 to the rear of the firebox portion.

A third vertically-extending baffle 112 is centered behind the firebox and extends between the rear walls 46, 64 of the firebox and jacket from the bottom of the first air space to the corner between rear firebox walls 46 and 48. Baffle 112 divides the incoming airflows and directs them upwardly so that the tubes 70 on each lateral side of the baffle receive approximately equal volumes of air.

A fourth baffle 114 extends horizontally between the side walls 65 of the jacket at a position immediately above tube openings 71. Baffle 114 is inclined downwardly parallel to tubes 70 from the upper rear wall 48 of the firebox to the rear wall 64 of the jacket. Thus, baffle 114 deflects most of the air rising in the rear portion of the first air space through intake openings 71 into the tubes.

The remaining air flows forwardly above baffles 108 toward the front of the firebox along side walls 44 for further heating before re-entering the room via upper portions of frontal air openings 20, 21.

FIG. 5 Embodiment

The fireplace furnace 210 of FIGS. 4 and 5 has a firebox portion 14 and jacket 16 similar to the corresponding parts of the combination fireplace furnace and cookstove 10. However, it lacks the forward protruding cookstove portion 15 and and baffle 80 (FIG. 3). Instead, the fronts of both the firebox and jacket are substantially flush with one another at the front wall of the fireplace, and the firebox has a front wall 147.

Wall 147 extends vertically from bottom wall portion 53 to a forward extension 149 of upper wall 52. It extends across the firebox chamber between side walls **44, 44*a*. It is connected to side walls 44, 44*a* and 44** so as to close off the second air space at the front.

Wall 147 includes a front access opening 130 having a door frame 32 adapted to interchangeably accept either door **34*a* (FIG. 3) or door 34*b*, as described above in connection with the FIG. 2** Embodiment.

A vertical row of holes 104 extend through front wall 147 on each side of the access opening. Such holes, framed by cowlings 106, provide frontal air openings connecting the second air space 100 to the ambient room air.

Several variations of the foregoing embodiments may be employed within the spirit of the invention. For example, jacket 16 could be omitted so that the side and rear walls of the fireplace 12 form the outer boundary of air space 18. If this arrangement is employed, a barrier must be provided for preventing air within the air space from escaping up the chimney. This approach is particularly useful if the existing fireplace is too small to accommodate the additional space requirements of a jacket.

The blowers also can be omitted without impairing the ability of my apparatus to heat a room by radiation from the cookstove portion and convection of air through the first and second air spaces and through the tubes.

Operation

The operation of the present invention will be readily apparent from the foregoing description. However, summarizing such operation for both embodiments, a fire F is built within firebox chamber with logs L or other material supported on a grate or andirons or on the existing fireplace floor, and door 34 is closed and latched. Damper control handle 60 is adjusted to position damper plate 56 in a desired open position so that exhaust gases and smoke can escape upwardly into the fireplace chimney. If steel door **34*a* is employed, draft cover 43** is manually adjusted to control the rate of burning of the fire.

With the fire burning satisfactorily, blowers 92, 93 are turned on using control knob 96. The blowers and natural convection cause ambient room air to enter the first air space 18 through the lower intake portions of frontal air openings 20, 21 and circulate beneath baffles 108 along side walls 44*a* toward the rear of the firebox. Diverters 110 divert a portion of the incoming air flow through rear openings 102 into the second air space 100. Such portion of air reverses direction and flows through air space 100 toward openings 104. Contact with walls 44*a* and 44*b* heats the air before it re-enters the room, and cools walls 44*a* to protect the blowers. The remainder of the incoming air flow bypasses baffles 110 and proceeds to the rear of the firebox. There, such air is progressively heated by contact with, and radiation from, the heat exchanging surfaces of the rear firebox walls and the tubes 70 as it flows toward the front tube outlets and the upper discharge portions of air openings 20, 21 to re-enter the room.

In the FIG. 3 Embodiment, baffle 80 diverts the flow of smoke and gases toward the cookstove chamber. Consequently, as combustion products rise from fire F, portions of such products move forwardly along the lower surfaces of tube 70, while the remainder flow around the tubes before moving forwardly along them, as shown by arrow 74, 75 in FIG. 3. Thereupon, such products flow as shown by arrow 83 beneath forward baffle portion 82, rise through the opening between the front edge of baffle portion 82 and front wall 47 and then flow backward beneath cooktop 49, causing the cooktop to be heated sufficiently for cooking purposes. The smoke and gases then flow around the discharge ends of upper tubes 70 and out through flue 50.

In both embodiments of my invention, the glowing coals of fire F can be banked to keep the fire burning slowly through the night. To bank the fire, the coals are heaped on the floor of the fireplace to reduce the amount of air to which the coals are exposed thereby slowing their rate of burning. The rate of burning can be further slowed by reducing the draft air entering the firebox. In this way the coals can be kept alive overnight.

The coals heat the inner side walls 44*b*, but the adjacent blowers remain unharmed, even when turned off, because cool room air flowing convectively through the second air spaces 100 absorbs much of the heat, thereby insulating the blowers. This airflow is aided by the convectional movement of air upwardly along baffles 108 and through tubes 70. The air thus heated returns to the room, providing some additional heat for the room even though the fire is no longer actively burning.

To restart the fire, the coals are uncovered and exposed to the air entering access opening 30 to permit them to burn faster and hotter. Fuel, such as paper and kindling, is then added and the coals are fanned briefly to ignite the fuel. Additional fuel can then be added, the door closed and latched, and the draft mechanism opened up to admit additional air into the firebox chamber.

Additional Modifications and Options

FIGS. 9–15 disclose several options and modifications of the two embodiments of fireplace furnace previously described for enhancing the operation of such furnaces.

Figure 9:
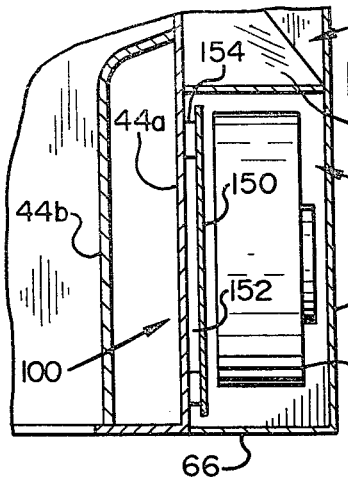
FIG. 9 is a partial sectional view of a fireplace furnace similar to that of FIG. 6 but with a modified intake portion comparable to the lower right hand portion of FIG. 6.

FIG. 9 discloses a modification of one portion of the furnace-stove embodiment of FIG. 3, being a modification of the lower right-hand portion of FIG. 6. In FIG. 9 a blower 93 is mounted within the air inlet 20 between jacket sidewall 65 and the firebox outer sidewall 44*a* and below the baffle 108 in accordance with the construction of FIG. 6. However, in FIG. 9 blower 93 is shielded from the heat of the firebox by a heat shield plate 150 spaced outwardly from outer firebox sidewall 44*a* and between such sidewall and the blower to provide a third wall and create a second insulating air space 152 between the firebox chamber and the blower. This additional air space 152 insures that the blower will not be destroyed in the event that a hot fire should be built within the firebox with the blower inadvertently turned off. Shield 150 can be made of metal and is spaced from the firebox sidewall 44*a* by spacer blocks 154. Plate 150 is preferably rectangular in shape and covers an area sufficient to fully shield the side of the blower facing the firebox.

Figure 10:
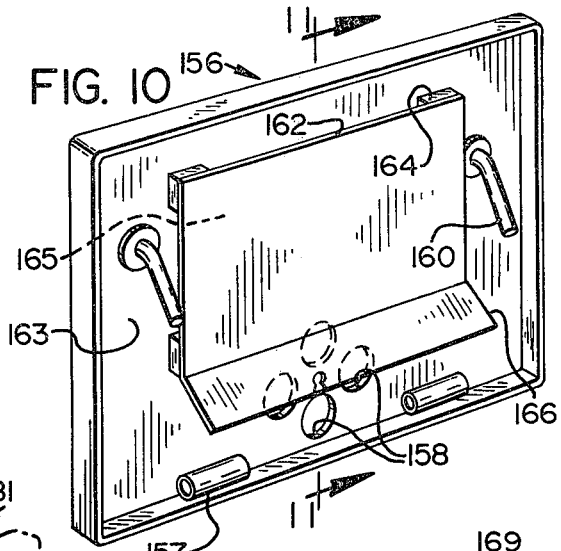
FIG. 10 is a perspective view of a modified steel door for the furnaces of FIGS. 2 and 4.
Figure 11:
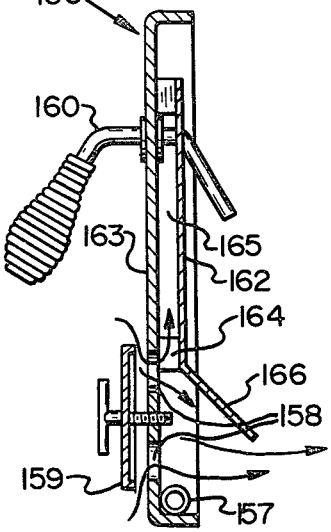
FIG. 11 is a sectional view taken along the line 11—11 of FIG. 10.

FIGS. 10 and 11 show the construction of a steel door 156 suitable for use on the furnace embodiments of either FIG. 3 or FIG. 5 in place of the steel door 34*a* of FIG. 3. Door 156 includes hinge sleeves 157 for hinging the door to the front of the firebox below access opening 30, multiple draft openings 158 and a screw-adjustable draft cover plate 159 and door latching handles 160, which operate in much the same way as the corresponding parts of the door 34*a* of FIG. 3. However, in the FIGS. 10–11 embodiment, a combination heat shield and baffle plate 162 is mounted to the inside of the front door plate 163 and in spaced relationship thereto by spacer blocks 164 to create an insulating air space 165 between plate 163 and heat shield 162. The shield protects the door from intense heat which may be generated within the firebox and thereby protects the door from warping. The lower portion of heat shield 162 is angled downwardly and rearwardly to provide a baffle portion 166 rearwardly of the draft openings 158. Thus, draft air entering the openings 158 as permitted by the draft cover plate 159 divides as it enters the firebox, with some of the draft air being deflected upwardly into the air space 165 to provide a cooling curtain of air passing between heat shield 162 and front cover plate 163 to help reduce the temperature of the front cover plate. Another portion of the incoming draft air is deflected downwardly by baffle portion 165 and directly into the lower portion of the firebox, where it provides the fire with combustion air.

Figure 13:
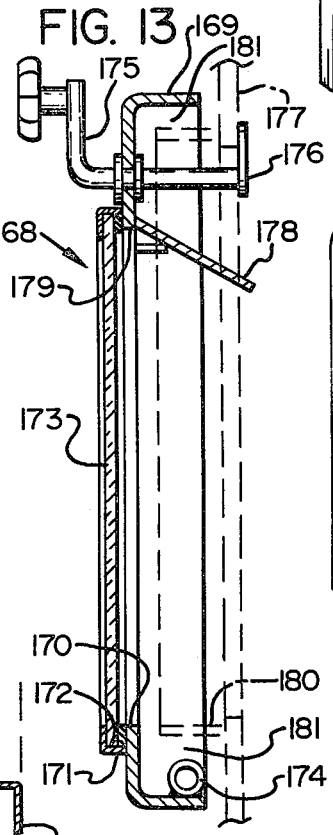
FIG. 13 is an enlarged sectional view taken along the line 13—13 of FIG. 12.
Figure 12:
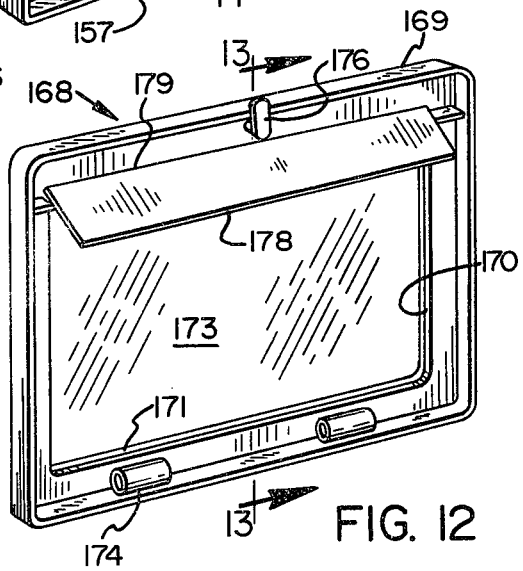
FIG. 12 is a perspective view of a modified glass door for the furnaces of FIGS. 2 and 4.

FIGS. 12 and 13 show a modified glass door 168 suitable for use with either the furnace embodiment of FIG. 3 or that of FIG. 5 instead of the glass door 34*b* shown in FIG. 5. Door 168 includes a flanged rectangular door frame 169 with a rectangular opening 170 from the edges of which a smaller rectangular frame 171 projects forwardly to define a channel 172 for retention of a pane of glass 173. The lower inside flanged surface of frame 169 mounts a pair of hinges 174 which receive hinge pins (not shown) fixed to the firebox itself. A crank handle 175 is rotatably mounted in frame 169 and has a latch member 176 which, when rotated to an upward position, interengages an inside surface of a firebox wall portion 177 to hold the door closed.

A baffle plate 178 extends at an angle downwardly and inwardly from the full length of the upper inside edge 179 of frame 169 to deflect smoke above the baffle away from glass 173. The baffle also helps hold a wall of incoming draft air at the inside of the glass to inhibit smoke from reaching the glass. Door 168 is sized to fit over a forwardly projecting flanged firebox front wall portion 180 defining the firebox opening in such a manner that an air gap 181 is provided between the outer perimeter of the door frame 169 and the inner perimeter of the firebox front wall portion 180 when the door is closed. This provides a constant supply of draft air along all four sides of the door frame, thereby washing the glass 173 with fresh air to help keep it clear of smoke.

Figure 15:
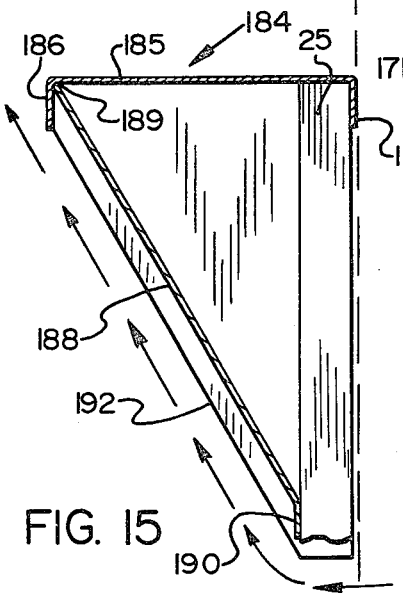
FIG. 15 is an enlarged sectional view taken along the line 15—15 of FIG. 14.
Figure 14:
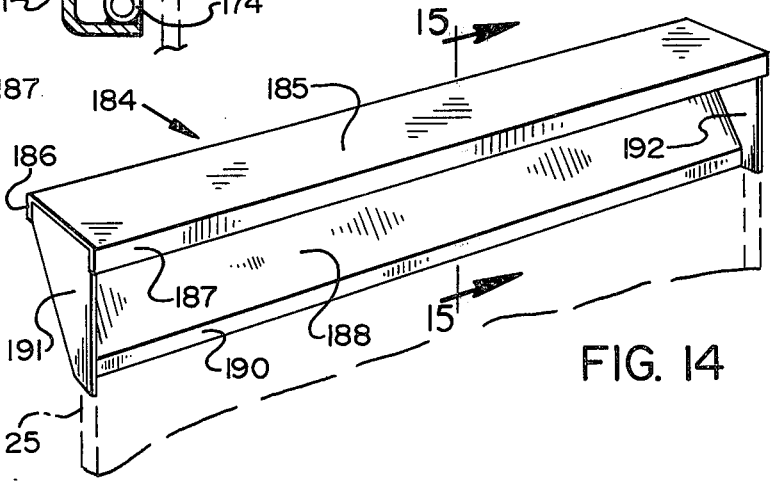
FIG. 14 is a perspective view of a deflector attachment for the furnaces of FIGS. 2 and 4.

FIGS. 14 and 15 show an optional deflector means 184 designed to be installed along the upper edge of the grille frame 25 of either the FIG. 3 or the FIG. 5 furnace embodiment. The purpose of the deflector is to deflect warm air outwardly into the room rather than allowing it to rise toward the ceiling as the air is discharged into the room from the upper heat exchange tubes 70.

The deflector is preferably made of sheet metal and includes a horizontal top panel 185 with downturned front and rear flanges 186, 187. A front deflector panel 188 angles downwardly and rearwardly from an upper edge 189 joined, as by welding, to the inside front corner of top panel 185. The rear edge of front panel 188 terminates in a downturned flange 190 forwardly of flange 187. The opposite ends of the deflector assembly formed by the top and front panels are closed by end panels 191, 192 which are joined, as by spot welding, to the top and front panels. The completed structure as described forms an open-backed box of generally right triangular cross section as shown in FIG. 14.

The deflector 184 is installed by hooking rear flange 187 over the top edge of grille frame 25 of the furnace. Lower edge flange 190 of front panel 188 thus abuts the upper grille screen 26 and side portions of the grille frame 25 to stabilize the deflector. Side panels 191, 192 of the deflector overlap the side frame members of grille frame 25, as shown in FIG. 15, to further stabilize the installation and prevent any endwise movement of the deflector along the grille frame.

Use of the deflector is recommended especially where the furnace is installed in close proximity to an overhead wooden mantle to prevent heat buildup beneath the mantle.

Having illustrated and described the principles of my invention in what are presently preferred embodiments, it should be apparent to those skilled in the art that such embodiments can be modified without departing from such principles. I claim as my invention all such modifications as come within the true spirit and scope of the following claims.

I claim:

1. A fireplace furnace adapted for insertion as a unit into the front opening of an existing fireplace having fireplace walls and a chimney, the fireplace furnace comprising:

heat exchanging wall means including top, rear and opposite side walls defining a firebox forming a firebox chamber, said firebox being sized such that said wall means are adapted to be spaced inwardly of the existing fireplace walls to define a first air space surrounding said firebox, at least one of said opposite side walls including inner and outer wall portions spaced laterally apart to define a second air space between said firebox chamber and said first air space and isolated from said chamber;

said first airspace including a frontal air intake opening for admitting room air into said first air space;

said second airspace including a frontal air exhaust opening connecting said second air space to said room air;

means adjacent said rear wall defining a rear air inlet opening into said second air space from said first air space; and means for preventing said room air from escaping from said first air space up the chimney.

2. Apparatus according to claim 1 including second wall means defining a jacket surrounding said firebox, said jacket being spaced apart from said heat exchanging wall means to enclose said first air space and prevent said room air from escaping from said first air space up the chimney of the fireplace.

3. Apparatus according to claim 1 including baffle means for directing air in said first air space through said rear air opening into said second air space.

4. Apparatus according to claim 1 or 3 including blower means in said first air space adjacent to said side wall for blowing room air into said first air space.

5. Apparatus according to claim 4 including heat shield means within said first air space and between said blower means and one of said two wall portions, said heat shield means being spaced from said one wall portion to create an insulating air space therebetween.

6. Apparatus according to claim 1 including a first baffle extending along said side wall to divide said first air space into upper and lower portions; said first baffle being inclined upwardly from front to rear to a position above said rear opening.

7. Apparatus according to claim 6 including a second baffle rearward of said rear opening and extending generally vertically across a lower portion of said first air space for diverting a portion of incoming air flow into said second air space.

8. Apparatus according to claim 1 including multiple heat exchange tubes passing through said firebox from air intake openings communicating with said first air space at the rear of said firebox to air discharge openings communicating with the room air at a frontal portion of said firebox.

9. Apparatus according to claim 8 in which said tubes include multiple upper heat exchange tubes passing through an upper portion of said firebox at an upward inclination from back to front thereof.

10. Apparatus according to claim 7 including:

two of said firebox side walls, one on each lateral side of said firebox, each having two wall portions spaced laterally apart to define second air spaces on each side of the firebox;

a pair of blower means positioned within said first air space, one along each of the side walls of said firebox just inwardly of said air intake openings, for inducing room air into said air intake openings and expelling said air rearwardly into said first air space along said side walls; and a vertically extending flow-dividing baffle means positioned across a portion of said first air space at the back of said firebox for distributing a portion of the rearwardly-expelled air flow approximately equally among said tubes.

11. Apparatus according to claim 8 including baffle means in said first air space at the rear of said firebox extending horizontally above said air intake openings for directing incoming air flow into said intake openings.

12. Apparatus according to claim 1 including stove wall means extending forwardly from said heat exchanging wall means to define a stove portion as a forward continuation of said firebox; said stove portion protruding forwardly from the front of a fireplace opening into a room when said firebox is positioned within a fireplace.

13. Apparatus according to claim 12 in which said stove wall means includes a double-walled stove side wall having two laterally spaced-apart stove side wall portions extending forwardly from the two wall portions of said firebox side wall to define a forward extension of said second air space.

14. Apparatus according to claim 12 including internal baffle means for directing all smoke and gases rising from a fire in the firebox forwardly into the stove portion and then rearwardly along an upper heat exchanging wall of said stove portion.

15. Apparatus according to claim 1 in which the bottom of said firebox is open so that a fire can be built on the floor of the existing fireplace and coals of said fire can be banked thereon.

16. Apparatus according to claim 1 wherein said firebox includes a front wall having a front access opening for inserting fuel into said firebox and a metal door for closing said opening, said metal door including a front door plate and a heat shield plate spaced rearwardly of said front door plate to create an air space between said door plate and shield plate.

17. Apparatus according to claim 16 including draft air openings in a lower portion of said front door plate, said heat shield plate having a rearwardly and downwardly angled lower portion defining a baffle overlying at least a portion of said draft openings to direct at least a portion of said draft air inflow downwardly within said firebox.

18. Apparatus according to claim 17 wherein said baffle and heat shield are positioned to divide draft air inflow so as to divert path of said inflow upwardly into said air space.

19. Apparatus according to claim 1 wherein said firebox includes a front wall having a front access opening and a door for closing said opening, said door including a door frame defining a central opening and a retention means for retaining a pane of glass within said central opening, said door including attachment means for attaching said door to said firebox over said access opening so as to provide a draft air space between the outer perimeter of said door frame and the inner perimeter of the front wall adjacent said access opening when said door is closed.

20. Apparatus according to claim 19 including a baffle member carried by an upper portion of said door frame, said baffle member extending downwardly and inwardly toward the firebox chamber from its connection to said frame to shield said glass from smoke and direct a portion of draft air inflow along said glass.

21. A fireplace furnace according to claim 1 wherein said firebox includes a front access opening and closure means for said opening, a grille front in surrounding relationship to the opposite sides and top of said access opening and covering said fireplace opening laterally outwardly of said firebox, said grille front including a grille frame including a horizontal frame portion along the upper edge of said grille front and vertical side frame portions along the opposite side limits of said grille front, and deflector means removably attachable to said grille front along said upper edge, said deflector means including a front panel extending at an angle upwardly and outwardly from said grille front, and a top panel projecting horizontally outwardly from said upper edge and joining an upper edge of said front panel, said top panel including downturned flange means for hooking said top panel to said horizontal frame portion and said front panel having a lower edge in abutment against said grille front when said top panel is hooked to said horizontal frame portion.

22. Apparatus according to claim 21 wherein said deflector means includes opposite side panels joined to the opposite ends of said front and top panels and adapted to overlap said opposite vertical side frame portions when said top panel is hooked to said horizontal frame portion.

23. A fireplace furnace for insertion as a unit within a fireplace opening and spaced from existing fireplace walls, said furnace comprising:

top, rear and opposite heat exchanging sidewall means defining a firebox having a front opening, closure means for said front opening, including an access door, said top wall means defining an exhaust opening for exhausting combustion gases from said firebox, at least one of said opposite sidewall means including an inner sidewall and an outer sidewall laterally spaced from one another and interconnected to define an air duct extending substantially the full length of said firebox from adjacent said rear wall means to said front opening, said air duct including a rear air inlet opening through the outer sidewall adjacent said rear wall means and a front exhaust opening extending through said closure means so that ambient room air can flow rearwardly along the firebox in contact with said outer sidewall, into the air duct through the rear air inlet opening, forwardly through the air duct in contact with the inner sidewall and out the front exhaust opening.

* * * * *

UNITED STATES PATENT AND TRADEMARK OFFICE

CERTIFICATE OF CORRECTION

PATENT NO. : 4,305,373

DATED : December 15, 1981

INVENTOR(S) : DONALD S. MARTENSON

It is certified that error appears in the above-identified patent and that said Letters Patent are hereby corrected as shown below:

Column 13, line 39, "path" should be--part--;

Signed and Sealed this

Fourth Day of May 1982

[SEAL]

Attest:

GERALD J. MOSSINGHOFF

Attesting Officer

Commissioner of Patents and Trademarks